US006457339B2

(12) United States Patent
Komura

(10) Patent No.: US 6,457,339 B2
(45) **Date of Patent: *Oct. 1, 2002**

(54) ROCKING PRESS MACHINE

(75) Inventor: Takao Komura, Aichi (JP)

(73) Assignee: Fuji Seiko Co., Ltd., Hashima (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 41 days.

(21) Appl. No.: 09/328,154

(22) Filed: Jun. 8, 1999

(30) Foreign Application Priority Data

Dec. 25, 1998 (JP) ..... 10-369574

(51) Int. Cl.[7] ..... B21J 13/03
(52) U.S. Cl. ..... 72/67; 72/406
(58) Field of Search ..... 72/67, 74, 115, 72/126, 406

(56) References Cited

U.S. PATENT DOCUMENTS 1,677,722 A * 7/1928 Lowrie ..... 72/126
1,696,229 A * 12/1928 Fantz ..... 72/126
3,690,278 A * 9/1972 Rautavalta ..... 72/74
4,982,589 A * 1/1991 Nomura ..... 72/67

* cited by examiner

*Primary Examiner*—Lowell A. Larson
(74) *Attorney, Agent, or Firm*—Richard M. Goldberg

(57) ABSTRACT

A rocking press machine includes a swinging metal die 2 and a rocking shaft 1 mounted above the metal die 1 and transmitting a swinging motion to the metal die 2, with the angle of eccentricity of the central axis thereof and the angular velocity of the orbiting motion thereof being adjustable. A friction disk 3 is provided between the metal die 2 and rocking shaft 1, a gyro 4 encloses the metal die 2 or a frame 20 surrounding the metal die 2 and supports 5 provided outside the gyro 4, first projections 61 and first recesses 71 rotatably supporting the first projections formed on the metal die 2 or the surrounding frame 20 and in the gyro 4, second projections 62 and second recesses 72 rotatably supporting the second projections formed on the gyro 4 and the supports 5. The rocking press machine permits the metal die 2 to swing with freedom of angular motion in a two dimensional space, prevents the metal die 2 from rotating on its own central axis, and, thereby, permits obtaining accurate patterns. The rocking press machine forms accurate patterns by preventing shifts that might be caused by the rolling motion of the metal die over the surface of the work and resultant undesirable effects in pattern forming.

4 Claims, 6 Drawing Sheets

THE A-A LINE

THE B-B LINE

THE A-A LINE

THE B-B LINE

ROCKING PRESS MACHINE

BACKGROUND OF THE INVENTION

This invention relates to rocking press machines having rocking shafts that are capable of various swinging motions.

The rocking press machine is a machine that forges metal by means of a combination of a rocking shaft and a metal die. The lower segment of the rocking press comprises a hydraulic press that supports the pressure exerted by the rocking shaft and carries a metal stock to be forged and other devices.

The basic principle of the rocking press machine is to allow the rocking shaft 1 to swing about the central axis thereof with an adjustable angle of eccentricity and an adjustable orbital angular velocity, as shown in FIG. 2. Then, the metal die 2 integral with the rocking shaft 1 swings and thereby forges the metal placed therebelow into a desired shape.

Various swinging motions are attained by varying the angle of eccentricity and orbital angular velocity of the rocking shaft about its own central axis, whereby the metal stock pressed by the metal die 2 is formed into various shapes.

With conventional rocking press machines, the rocking shaft 1 and the metal die 2 therebelow are in one piece. Furthermore, the metal die 2 is shaped like a truncated cone having vertex O at the bottom end thereof, as shown in FIG. 1.

When the working face of the metal die 2 of conventional rocking press machines of this type has line contact with the metal stock or, in other words, the angle of eccentricity $\theta$ the central axis of the rocking shaft 1 is equal to the angle of inclination a of the metal die 2 shaped like a truncated cone as shown in FIG. 1, the metal die rolls over the surface of the metal stock about vertex O as the central axis of the rocking shaft 1 moves in orbit.

If the angular velocity of the orbiting central axis of the rocking shaft 1 with respect to the vertical axis is $\omega$ and the angular velocity of the central axis of the metal die 2 rotating on its own axis is $\omega'$ in FIG. 1, the vertical and horizontal components of the angular velocity $\omega'$ are $\omega' \cos \alpha$ and $\omega' \sin \alpha$, respectively.

If the distance between a specific point P of the metal die 2 that is rolling in contact with the metal stock and vertex O is r and the intersection point between a line perpendicular to the horizontal surface at point P and the central axis of the metal die 2 is S in FIG. 1, SP=rcot $\alpha$.

The orbital speed at point P is $\omega r$.

When the metal die 2 that rolls as described before rotates on its own axis about vertex O, the rotating speed of the horizontal component $\omega' \sin \alpha$ of the angular velocity $\omega'$ at point X and with the orbital speed at point P given above, which can be expressed as SP $\omega' \sin \alpha = r\omega' \cos \alpha$ where SP is the radius, is equal to $\omega r$ described earlier.

Therefore, equations or $\omega r = \omega' r \cos \alpha$ and $\omega' = \omega / \cos \alpha$ hold.

However, the rotation of the metal die on its own axis, resulting from its rolling, produces considerable interference in forming a desired pattern on the metal stock by various swinging motions.

To explain the above fact, FIG. 2 shows a view that is more generalized than FIG. 1. That is, FIG. 2 shows a case in which the angle of eccentricity $\theta$ of the central axis of the rocking shaft 1 is not equal to the angle of inclination $\alpha$ of the metal die 2 or, in other words, the metal die shaped like a truncated cone is not in contact with the surface of the metal stock being worked. Here, a normal line extending from point P on the surface of the conically shaped lower part of the metal die intersects the central axis thereof at point Q, and OQ=a and PQ=b. (Unlike FIG. 1, FIG. 2 shows a case in which the conically shaped part of the metal die is away from the horizontal plane.)

When the metal die rotates on its own axis, point P will become separated from the surface of the metal stock in some instances. P' and Q' in FIGS. 2 and 3 are projections of points P and Q on the abscissa and ordinate in a horizontal plane centered at vertex O. OP' and OQ can be expressed as follows:

$$OQ' = a \sin \theta(t) \text{ and } P'Q' = b \cos \theta(t)$$

(A functional form $\theta(t)$ is used because $\theta$ can change with time.)

In FIG. 2, point Q rotates about a vertical line passing through vertex O with angular velocity $\omega$, whereas point P rotates not only about the same vertical line passing, through vertex O with angular velocity $\omega$ but also in the opposite direction about a vertical line passing through point Q with an angular velocity equal to the vertical component of angular velocity $\omega'$ of the rotation of the rocking shaft on its own central axis.

When $\theta = \alpha$, $\omega' = \omega / \cos \alpha$ as described earlier by reference to FIG. 1. The inclined surface of the metal die shaped like a truncated cone is away from the surface of the metal stock as shown in FIG. 2. However, $\omega'$ is not always equal to $\omega / \cos \alpha$ because of the rotation on its own axis due to the inertia effect of the rolling motion.

The vertical component of angular velocity $\omega'$ of the rotation of the rocking shaft on its own central axis is equal to $\omega' \cos \theta(t)$, as is evident from FIG. 2.

Therefore, the velocity of angular motion in the vertical direction at point Q represents a value obtained by deducting the vertical component of angular velocity due to the rotation on its own axis $\omega' \cos \theta(t)$ from angular velocity $\omega$ of the orbiting central axis.

Thus, coordinates x and y of point P' in FIG. 3 can be expressed by the following equations:

$$x = a \sin \theta(t) \cos \omega t + b \cos \theta(t) \cos(\omega - \omega' \cos \theta(t))t$$

$$y = a \sin \theta(t) \sin \omega t + b \cos \theta(t) \sin(\omega - \omega' \cos \theta(t))t$$

The following equation can be derived from equation (1):

$$x^2 + y^2 = a^2 + b^2 + ab \sin 2\theta(t) \cos(\cos\theta(t))t \quad (2)$$

$x^2 + y^2$ cannot be kept constant because $\cos(-\omega' \cos \theta(t))\, t$ in equation (2) changes successively even if $\theta(t)$ remains constant.

This means that accurate control required in producing a circular motion that is, the most basic motion in swinging motions is impossible to achieve, let alone accurate control to ensure accurate production of more complex spiral or daisy motion.

FIG. 1 shows a condition in which the inclined surface of the metal die rolls in contact with the surface of the metal stock. If it is assumed that the time for point P to start rolling from a condition in which it is in contact with the metal stock being worked and come in contact with the same metal stock again is $t_0$, equation $\omega' t_0 = 2\pi$ holds. Then, the angle of rotation of point P in a horizontal plane is $\omega' t_0 = 2\pi \cos \alpha$. Therefore, it is impossible to hold the surface of the metal stock within an angular limit of $2\pi(1 - \cos \alpha)$.

Even if an attempt is made to obtain a desired pattern by pressing the surface of the metal stock with point P at intervals of $t_0$, it is impossible to accurately form the desired pattern because of the shift mentioned earlier.

The object of this invention is to provide rocking press machines whose metal dies do not rotate on their own axes by eliminating the shortcomings of conventional rocking press machines whose metal dies rotate on their own axes.

SUMMARY OF THE INVENTION

This invention eliminates the shortcomings of conventional rocking press machines described earlier by providing the following improvement:

(1) In a rocking press machine comprising a metal die adapted to swing about a vertex at a lower end thereof and a rocking shaft mounted above the metal die and transmitting a swinging motion to the metal die, with an angle of eccentricity of the central axis thereof and an angular velocity of the orbiting motion thereof being made adjustable, the improvement comprises a friction disk provided between the metal die and rocking shaft, a gyro enclosing the metal die, supports provided outside the gyro, first projections projecting outward from the metal die, first recesses to rotatably support the first projections therein formed in the gyro, second projections projecting inward or outward and second recesses to rotatably support the second projections therein formed in and on one or the other of the gyro and supports with each of a central axes of regions in which the first and second projections respectively fit in the first and second recesses being on a connecting straight line, two such lines passing through the vertex at the lower end of the metal die, and the line connecting the central axes of the first projections and the line connecting the central axes of the second projections being set at an angle in a horizontal plane.

(2) In a rocking press machine comprising a metal die adapted to swing about the vertex at the lower end thereof and a rocking shaft mounted above the metal die and transmitting a swinging motion to the metal die, with the angle of eccentricity of the central axis thereof and the angular velocity of the orbiting motion thereof being made adjustable, the improvement comprises a friction disk provided between the metal die and rocking shaft, an annular frame fastened to the metal die, a gyro enclosing the annular frame, supports provided outside the gyro, first projections projecting inward or outward and first recesses to rotatably support the first projections therein formed in and on one or the other of the annular frame and gyro, second projections projecting inward or outward and second recesses to rotatably support the second projections therein formed in and on one or the other of the gyro and frame, with each of the central axes of regions in which the first and second projections respectively fit in the first and second recesses being on the same straight line, two such lines passing through the vertex at the lower end of the metal die, and the line connecting the central axes of the first projections and the line connecting the central axes of the second projections being set at an angle in a horizontal plane.

BRIEF DESCRIPTION OF THE DRAWINGS

FIG. 4(*a*) is a plan view showing the metal die and rocking shaft in the vertical position. FIG. 4(*b*) is a cross-sectional side elevation taken along the line 4*b*—4*b* of FIG. 4(*a*) that shows the way in which the second projections fit in the second recesses. FIG. 4(*c*) is a cross-sectional side elevation taken along the line 4*c*—4*c* of FIG. 4(*a*) that shows the way in which the first projections fit in the first recesses.

FIG. 6(*a*) is a plan view showing the central axes of the metal die and rocking shaft in the vertical position. FIG. 6(*b*) is a cross-sectional side elevation taken along the line 6*b*—6*b* of FIG. 4(*a*) that shows the way in which the second projections fit in the second recesses. FIG. 6(*c*) is a cross-sectional side elevation taken along the line 6*c*—6*c* of FIG. 6(*a*) that shows the way in which the first projections fit in the first recesses.

FIG. 7(*a*) shows a circular path of motion. FIG. 7(*b*) shows a linear path of motion. FIG. 7(*c*) and FIG. 7(*d*) show a circular path of motion. FIG. 7(*e*) shows a spiral path of motion. FIG. 7(*f*) shows a daisy-like path of motion.

DETAILED DESCRIPTION

The structures (1) and (2) of this invention are identical except that the structure (1) does not have an annular frame fastened to the metal die which the structure (2) has.

Figure 1:
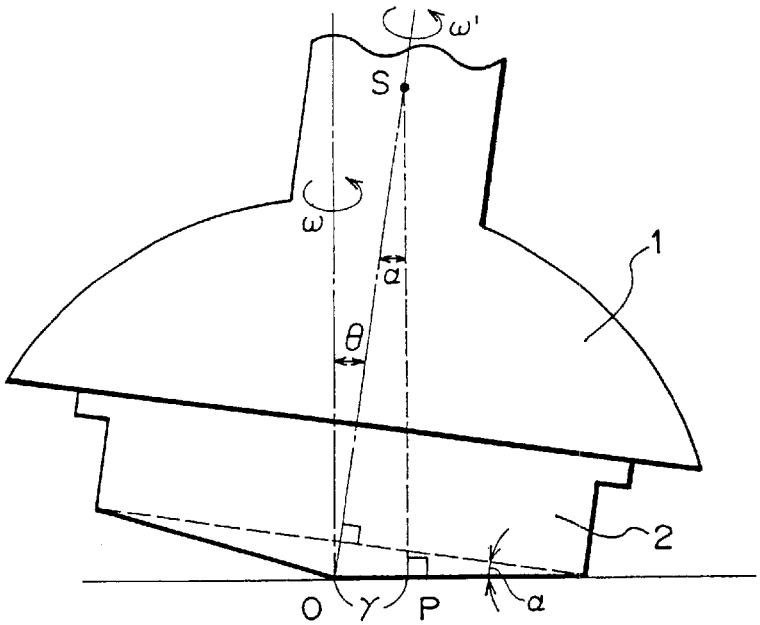
FIG. 1 is a side elevation showing the relationship between the rocking shaft and metal die in a conventional rocking press machine and illustrating the amount of angular velocity of the rotation on its own axis of the metal die performing a rolling motion.
Figure 2:
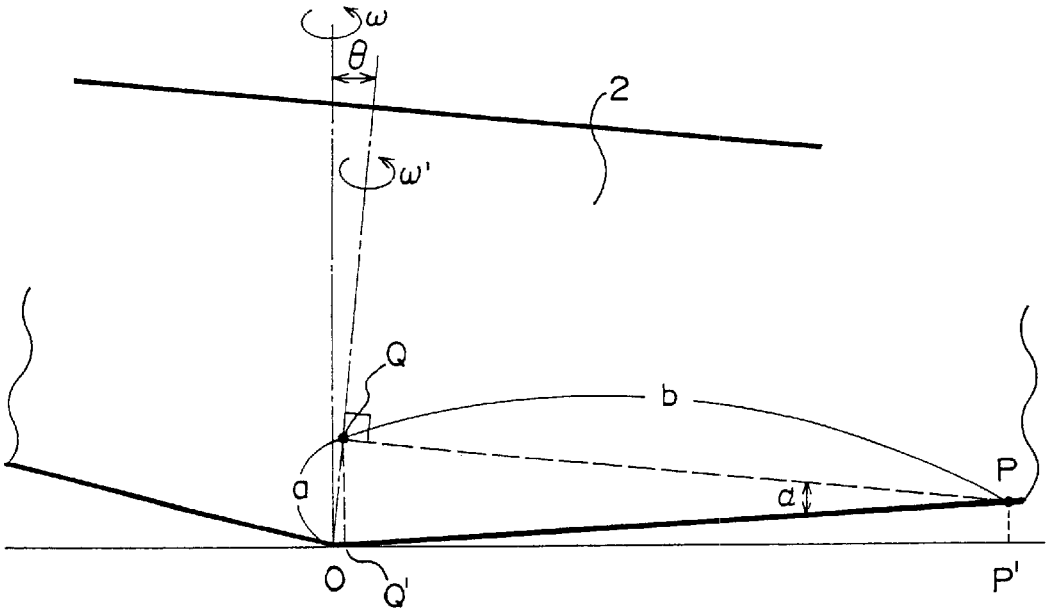
FIG. 2 is a side elevation of a conventional rocking press machine illustrating the position of point P on the inclined surface of the metal die rotating on its own axis, with the inclined surface of the metal die not in contact with the metal stock being worked, and the distance between point P and the vertex O in the horizontal direction.
Figure 3:
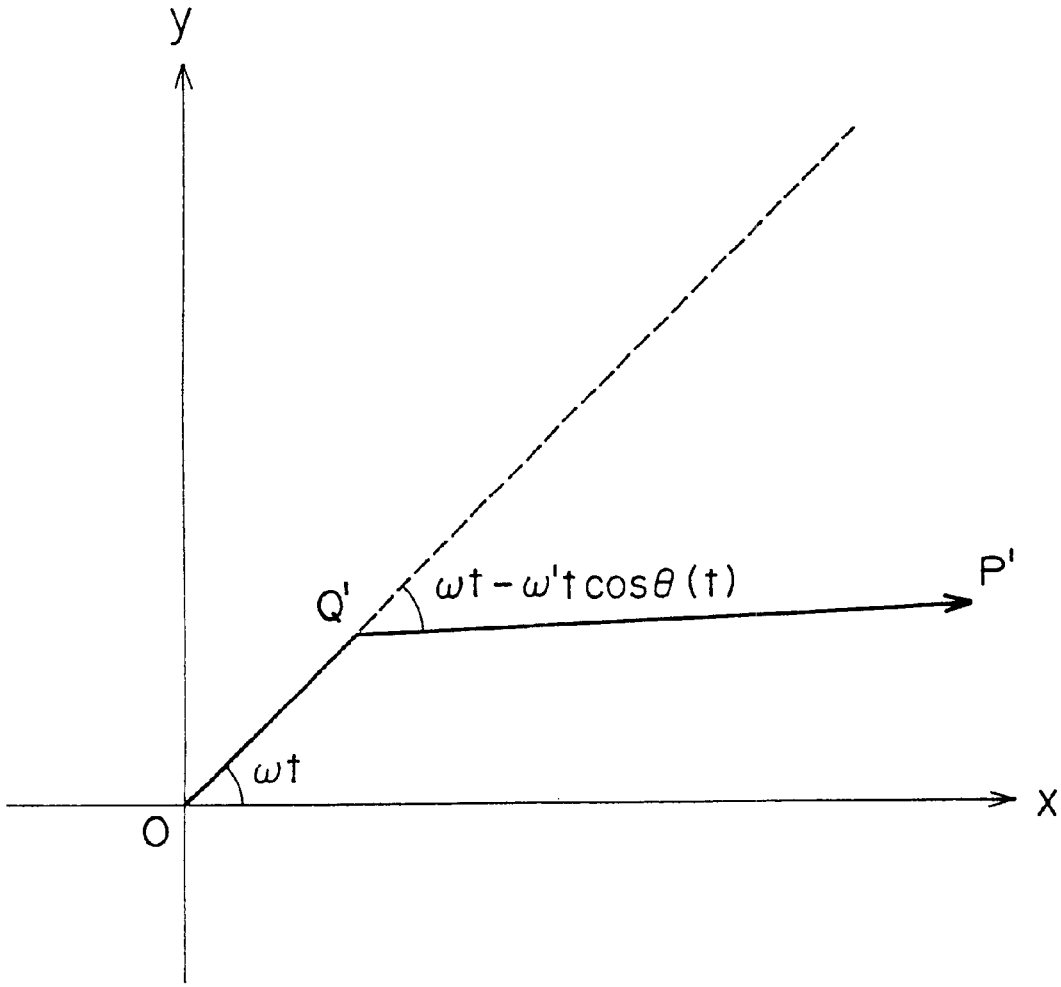
FIG. 3 is a graph illustrating equation (1) expressing point P on the inclined surface of the metal die.
Figure 4A:
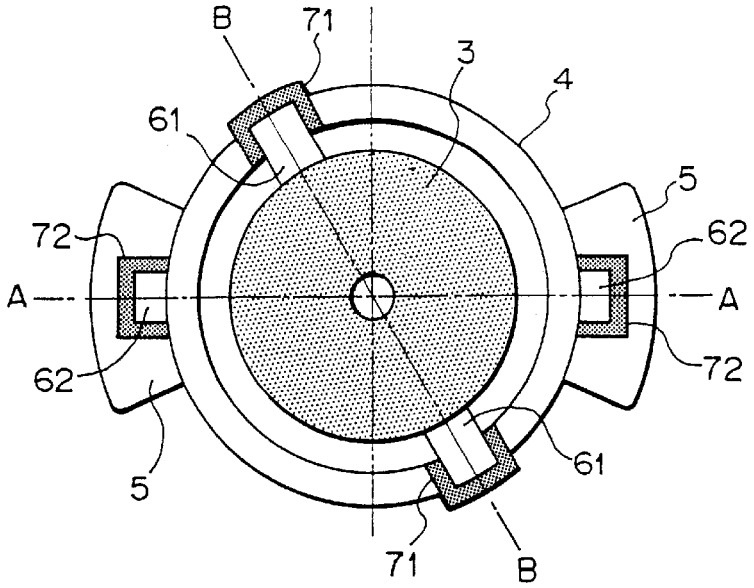
FIG. 4 contains views illustrating the basic principle of this invention.
Figure 4B:
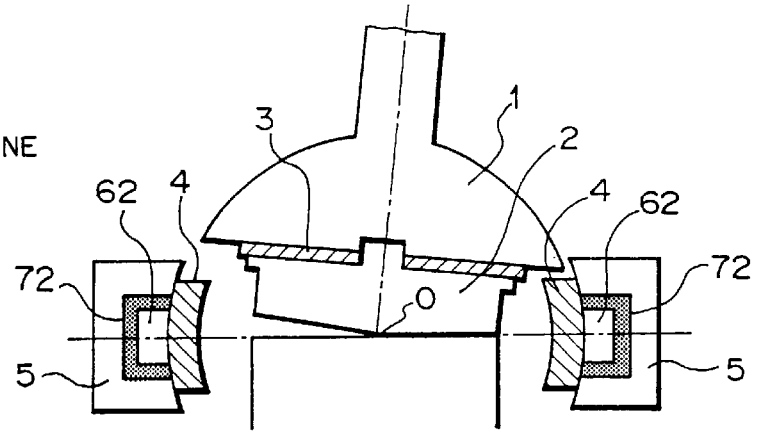
Figure 4C:
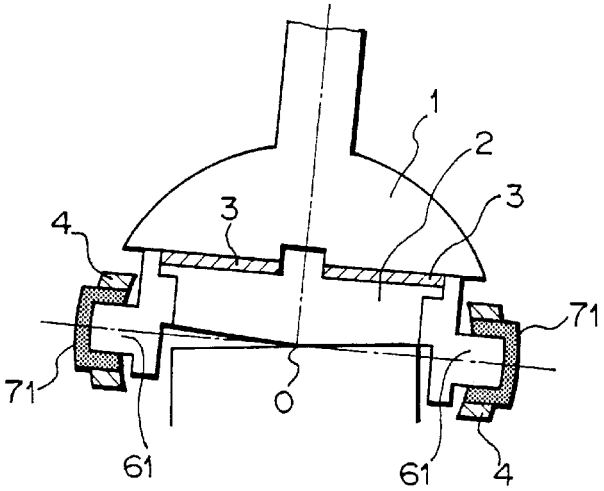

FIGS. 4(*a*) and (*b*) show the basic structure (1). As can be seen, a friction plate 3 in the shape of a friction disk is provided between a rocking shaft 1 and a metal die 2. (The basic structure (2) will be described by reference to a preferred embodiment.)

Therefore, the metal die 2 does not rotate together with the orbiting of the rocking shaft 1, but gives via the friction plate 3, the same angular changes as the three-dimensional angular changes exhibited by the bottom surface of the orbiting rocking shaft 1.

This invention provides a mechanism to prevent the metal die 2 from rotating on its own axis.

Figure 5:
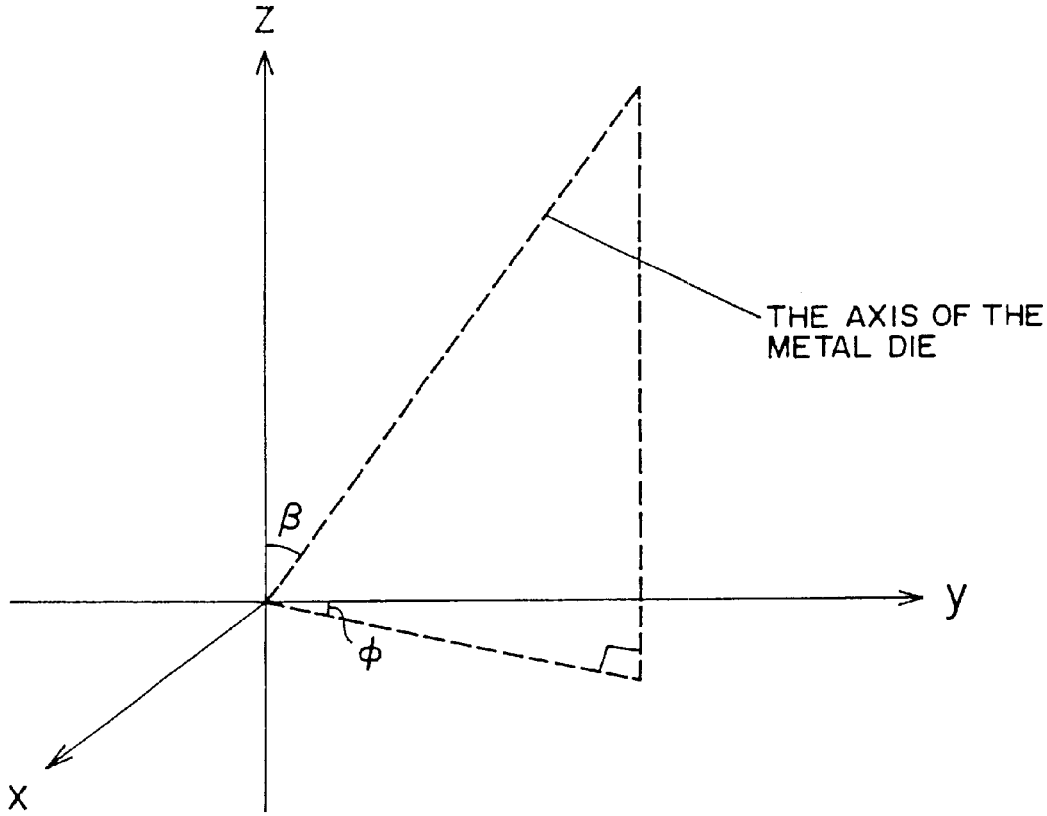
FIG. 5 is a three-dimensional graph that shows that the metal die must have freedom of angular motion in two dimensional space in order to perform swinging motions without rotating on its own axis.

FIG. 5 illustrates the basic principle of this mechanism. The metal die 2 is considered to have freedom of angular motion in a two-dimensional space when the central axis of the metal die 2 can move freely along a line at an angle of $\Phi$ from the horizontal and a line at an angle of $\beta$ from the vertical. When the central axis has freedom of angular motion in two-dimensional space, it follows that the entirety of the metal die 2 has freedom of angular motion in a two-dimensional space.

Therefore, the mechanism to prevent the rolling metal die 2 from rotating on its own axis must permit the metal die to have freedom of angular motion in a two-dimensional space while preventing rotation about the central axis thereof.

To fill the above requirement, the structure (1) of this invention has first projections 61 projecting outward from the metal die 2 and first recesses 71 to rotatably support the first projections 61 therein formed in a gyro 4, second projections 62 projecting inward or outward and second recesses 72 to rotatably support the second projections therein formed in and on one or the other of the gyro 4 and supports 5, as shown in FIGS. 4(*a*) and (*b*). (In FIGS. 4(*a*) and (*b*), the second projections project outward from the gyro 4 and the second recesses 72 are formed in the supports 5.)

For the gyro 4 to rotate in any desired direction, with second projections rotatably fitted in second recesses, it is essential that two second projections 62 are provided and the center axes of regions in which the second projections 62 are rotatably supported by the second recesses 72 are on the same straight line and passing through the vertex of the metal die 2. (The gyro 4 cannot achieve the rotation that allows the metal die 2 to swing about the vertex thereof if two second projections 62 are not provided as described above.)

The gyro 4 can change the swinging motion thereof with respect to the supports 5 with freedom of angular motion in one-dimensional space via the second projections 62 and second recesses 72.

Two first projections 61 must be provided and the center axes of regions in which the first projections 61 are rotatably supported by the first recesses 71 are on the same straight line and passing through the vertex of the metal die 2 for the same reason mentioned above for the second projections 62 and second recesses 72.

A combination of the first projections 61 and second recesses 71 permit the metal die 2 to change the swinging motion thereof with respect to the gyro 4 with freedom of angular motion in one-dimensional space.

If the straight line connecting the central axes of the first projections 61 and. the straight line connecting the central axes of the second projections 62 are aligned, the gyro 4 moves with freedom of angular motion in one-dimensional space but the metal die 2 cannot swing with freedom of angular motion in two-dimensional space. (In this condition, the metal die 2 and gyro 4 can only swing with freedom of angular motion in one-dimensional space about the central axes extending in the same direction.)

In the structures (1) and (2), the straight lines connecting the central axes of the first projections 61 and second projections 62 (which pass through the vertex O of the metal die 2) are designed to lie at different angles in a horizontal plane. This design permits the metal die 2 to achieve two swinging motions with freedom of angular motion in a two-dimensional space. One is due to the freedom of angular motion in one-dimensional space the metal die 2 has with respect to the gyro 4 and the other is due to the freedom of angular motion in one-dimensional space the gyro 3 possesses.

Either of the second projections 62 or second recesses 72 are provided on or in the supports 5. Therefore, the gyro 4 cannot make any other motions than the swinging with freedom of angular motion in one-dimensional space mentioned earlier and, therefore, cannot rotate on its own central axis passing through the vertex O of the metal die 2. (FIGS. 4(*a*) and (*b*) show the structure in which the second recesses 72 are formed in the supports 5.)

Similarly, the first recesses 71 provided in the gyro 4 cannot make any other motions than the swinging with freedom of angular motion in one-dimensional space mentioned earlier. Therefore, the first projections 61 prevent the metal die 2 from rotating on its own central axis passing through the vertex O thereof. As a consequence, the metal die 2 performs only a swinging motion about the vertex O thereof with freedom of angular motion in a two-dimensional space.

Engagement permitting the first projections 61 to rotate in the first recesses 71 and the second projections 62 to rotate in the second recesses 72 can be obtained in various combinations such as a combination of columnar projections and cylindrical recesses to support the columnar projections, a combination of projections and recesses to support the projections both having cross-sections shaped like truncated cones, and a combination of projections and recesses both having semi-spherical cross-sections. The essential requirement is that the cross-section normal to the central axis of each projection is circular in shape and each recess has a large enough circumference to surround said circular cross section of the projection.

To realize smooth engagement between the projections and recesses, a lubricant may be applied or a bearing may be installed therebetween, though they do not constitute an essential requirement of this invention.

Now that the metal die 2 does not rotate on its own axis, the angular velocity ω' of axial rotation becomes 0 in equation (1).

Therefore, equation (1) becomes as described below.

$$x=\{a \sin \theta(t)+b \cos \theta(t)\}\cos \omega t$$

$$y=\{a \sin \theta(t)+b \cos \theta(t)\}\sin \omega t \qquad (3)$$

Equation (3) can be converted as described below by using the addition theorem of trigonometic functions.

$$X=a/2(\sin\{\theta(t)+\omega t\}+\sin\{\theta(t)-\omega t\})+b/2(\cos\{\theta(t)+\omega t\}+\cos\{\theta(t)-\omega t\})$$

$$y=a/2(\cos\{\theta(t)+\omega t\}+\cos\{\theta(t)-\omega t\})+b/2(\sin\{\theta(t)+\omega t\}+\sin\{\theta(t)-\omega t\}) \qquad (3)'$$

If it is assumed that $\theta(t)+\omega t=\theta_1(t)$ and $\theta(t)-\omega t=\theta_2(t)$ in equation (3)' for the sake of simplification, equation (3)' can be expressed as follows:

$$x=a/2(\sin \theta_1(t)+\sin \theta_2(t)\}+b/2\{\cos \theta_1(t)+\cos \theta_2(t)\}$$

$$y=a/2(\cos \theta_2(t)+\cos \theta_1(t)\}+b/2\{\sin \theta_1(t)+\cos \theta_2(t)\} \qquad (3)''$$

From equation (3)", the following equation is derived.

$$x^2+y^2=1/14(a^2+b^2)+\{(a^2-b^2)2\}\cos\{\theta_1(t)+\theta_2(t)\}+ab \sin\{\theta_1(t)+\theta_2(t)\}.$$

This equation shows that when $\theta_1(t)+\theta_2(t)=20(t)$ is constant, point P executes a circular motion regardless of the value of ω, as shown in FIG. 7(*a*).

If $\theta_1(t)=\theta_2(t)$ or $\omega t=0$ in equation (3), then $$x=a \sin \theta_1(t)+b \cos \theta_1(t)$$

$$y=0$$

Thus, point P describes a path consisting of straight lines as shown in FIG. 7(*b*).

If $\theta_2(t)=0$ (or $\theta(t)=\omega t$), the following equation can be derived from equation (3).

$$(X-b/2)^2+(Y-a/2)^2=1/4(a^2+b^2)$$

In this case, point P describes a circular path with a radius of $\{(a^2+b^2)/2\}^{1/2}$ and centered on a point having coordinates (b/2, a/2) and forms a pattern drawn along the path, as shown in FIG. 7(*c*).

If $\theta_1(t)=0$ (or $\theta(t)=-\omega t$), the following equation can be derived from equation (3).

$$(X-b/2)^2+(y+a/2)^2=1/4(a^2+b^2)$$

In this case, point P described a circular path with a radius of $\{(a^2+b^2)/2\}^{1/2}$ and centered on a point having coordinates (b/2, −a/2) and forms a pattern drawn along the path, as shown in FIG. 7(*d*).

If a=b, the following can be derived from equation (3):

$$x+y=a\{\sin\theta_1(t)+\sin\theta_2(t)\}$$

$$x-y=a\{\cos\theta_1(t)+\cos\theta_2(t)\} \quad (4)$$

If coordinates (x, y) are rotated through an angle γ, coordinates (X, Y) are generally obtained. Then, the following relationships hold.

$$X=x\cos y+y\sin\gamma$$

$$Y=y\sin y+y\cos\gamma$$

If, therefore, coordinates (X, Y) are obtainable when (x, y) in equation (4) are rotated through −45°, the following relationships hold.

$$X=(a/2)\{\sin\theta_1(t)+\sin\theta_2(t)\}$$

$$Y=(a/2)\cos\theta_1(t)+\cos\theta_2(t)\} \quad (5)$$

If $\theta_1(t)=n\theta_2(t)$ (where n is a rational number greater than 1) holds in equation (5), point P describes a spiral path as shown in FIG. 7(*e*) (in which n=11) that is applicable to manufacturing articles having unsymmetrical patterns along the outer periphery of disks or toothed wheels.

By selecting the proper value of n, various types of spiral lines, from widely spaced ones to closely spaced ones, can be obtained at will. Furthermore, such selection can be either fixed or made variable while the rocking shaft 1 is moving.

When $\theta_1(t)=-\theta_2(t)/n$ (where n is a rational number greater than 1 and the minus sign indicates that $\theta_1(t)$ and $\theta_2(t)$ rotate in opposite directions) holds, point P describes a path shaped like a daisy (FIG. 7(*f*) shows a case in which n=21) that is suited for forging toothed wheels and other articles having radially arranged patterns.

By selecting the proper value of n, various types of daisy-like lines, from widely spaced ones to closely spaced ones, can be obtained at will. Furthermore, such selection can be either fixed or made variable while the rocking shaft 1 is moving.

As has been described, this invention permits the metal die 2 to perform not only circular and linear motions but also spiral and daisy-like motions and form corresponding patterns accurately.

Figure 6A:
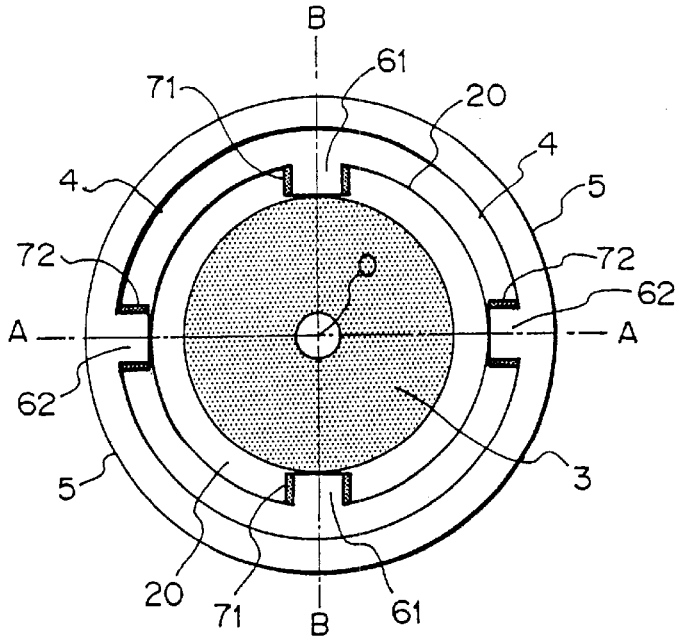
FIG. 6 contains views illustrating the construction of a preferred embodiment of this invention.
Figure 6B:
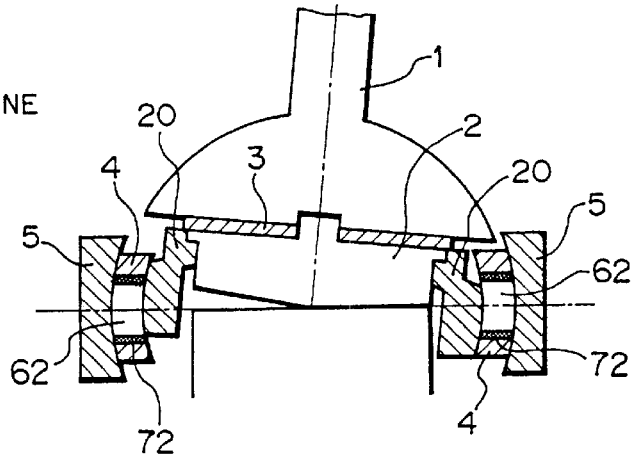
Figure 6C:
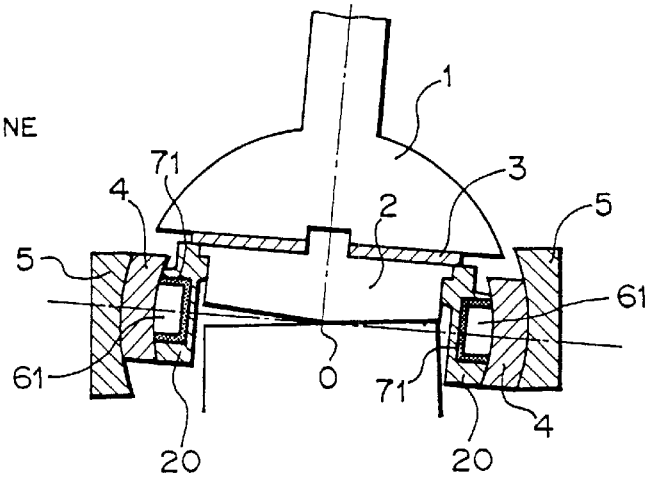
Figure 7A:
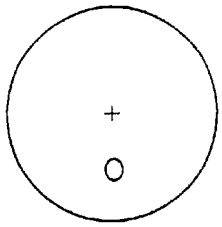
FIG. 7 show paths drawn by point P on the surface of the swinging metal die.
Figure 7B:
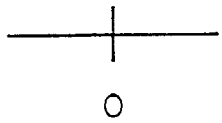
Figure 7C:
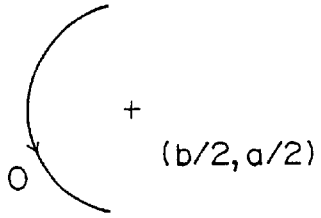
Figure 7D:
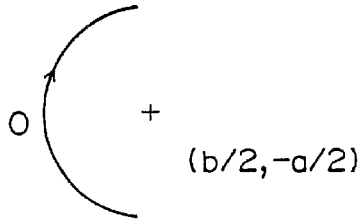
Figure 7E:
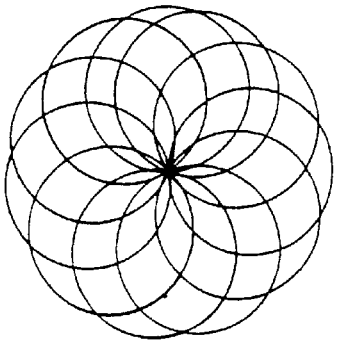
Figure 7F:
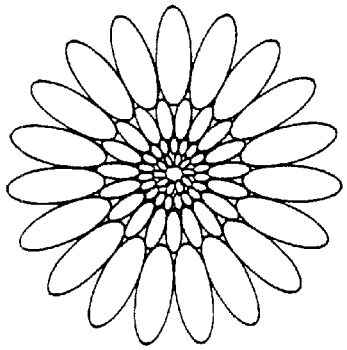

FIGS. 6(*a*), (*b*) and (*c*) show an embodiment based on the structure (2) that has two each first and second projections whose centers are disposed symmetrically with respect to the central axis of the metal die.

The first projections 61 and the second projections 62 project inward. The first projections 61 project from the gyro 4 and rotatably fit in the first recesses 71 formed in the annular frame 20 surrounding the metal die 2, whereas the second projections 62 project from the annular support 5 and rotatably fit in the second recesses 72 formed in the gyro 4.

In this embodiment, a straight line obtained by reproducing a straight line connecting the centers of the two first projections 61 on a plane by projection and a straight line obtained by reproducing a straight line connecting the centers of the two second projections 62 are perpendicular to each other, as shown in FIG. 7(*a*).

With this arrangement, the swinging surface of the gyro 4 and the swinging surfaces of the metal die 2 and the surrounding annular frame 20 are normal to each other in a horizontal direction, whereby the metal die 2 can efficiently acquire freedom of angular motion in a two-dimensional space.

It goes without saying that the embodiment based on the structure (2) can also realize swinging motions to draw the various patterns shown in FIG. 7.

While the structure (1) used in the description of operation has the first and second projections projecting outward, the embodiment based on the structure (2) described above has the first and second projections projecting inward.

It is also possible to reverse the direction of projection of the second projections in the structure (1) and the first and second projections in the structure (2).

It is possible to reverse the direction of projection of the first and second projections in the structure (2). The first projections can be projected outward and the second projections inward, or vice versa. By so doing, the desired swinging motion and pattern can be realized.

As has been described, this invention is of great value as it permits the metal die to swing about the vertex O thereof with freedom of angular motion in a two-dimensional space, prevents the metal die from rotating on its own central axis, and, thereby, permits obtaining accurate patterns through the use of the gyro mechanism comprising the friction disk, first and second projections, and first and second recesses in which the first and second projections are rotatably fitted.

What is claimed is:

1. In a rocking press machine comprising a metal die adapted to swing about a vertex at a lower end thereof and a rocking shaft mounted above the metal die and transmitting a swinging motion to the metal die, with an angle of eccentricity of the central axis thereof and an angular velocity of the orbiting motion thereof being adjustable, the improvement comprising:

a friction disk provided between the metal die and the rocking shaft, the friction disk having an upper surface in friction contact with a lower surface of the rocking shaft and a lower surface in friction contact with an upper surface of the metal die, a gyro enclosing the metal die, supports provided outside the gyro, first projections projecting outward from the metal die, first recesses to rotatably support the first projections therein and formed in the gyro, second projections projecting from one of the gyro and supports, and second recesses to rotatably support the second projections therein formed in the other of the gyro and supports, with each of the central axes of regions in which the first projections fit in the first recesses being on a same straight line, each of the central axes of regions in which the second projections fit in the second recesses being on a same straight line, said two lines passing through the vertex at the lower end of the metal die, and the line connecting the central axes of the first projections and the line connecting the central axes of the second projections being set at an angle to each other in a horizontal plane, and said metal die having a central axis and being non-rotatable about said central axis.

2. The improvement according to claim 1 in which the gyro is ring-shaped, the first and second projections are disposed symmetrically with respect to the central axis of the metal die, and the straight line connecting the central axes of the first projections and a straight line connecting the central axes of the second projections are normal to each other in a horizontal plane.

3. In a rocking press machine comprising a metal die adapted to swing about a vertex at a lower end thereof and a rocking shaft mounted above the metal die for transmitting a swinging motion to the metal die, with an angle of eccentricity of the central axis thereof and an angular velocity of the orbiting motion thereof being adjustable, the improvement comprising:

a friction disk provided between the metal die and the rocking shaft, the friction disk having an upper surface in friction contact with a lower surface of the rocking shaft and a lower surface in friction contact with an upper surface of the metal die, an annular frame fastened to the metal die, a gyro enclosing the annular frame, supports provided outside the gyro, first projections projecting from one of the annular frame and the gyro, first recesses to rotatably support the first projections therein formed in the other of the annular frame and the gyro, second projections projecting from one of the gyro and supports, and second recesses to rotatably support the second projections therein formed in the other of the gyro and supports, with each of the central axes of regions in which the first projections respectively fit in the first recesses being on a same straight line, each of the central axes of regions in which the second projections respectively fit in the second recesses being on a same straight line, said two lines passing through the vertex at the lower end of the metal die, and the line connecting the central axes of the first projections and the line connecting the central axes of the second projections being set at an angle to each other in a horizontal plane, and said metal die having a central axis and being non-rotatable about said central axis.

4. The improvement according to claim 3 in which the annular frame and gyro are ring-shaped, the first and second projections are disposed symmetrically with respect to the central axis of the metal die, and the straight line connecting the central axes of the first projections and the straight line connecting the central axes of the second projections are normal to each other in a horizontal plane.

* * * * *